United States Patent [19]

Nakano et al.

[11] 4,142,502

[45] Mar. 6, 1979

[54] ENGINE AND COMPONENT ARRANGEMENT

[75] Inventors: Keiichi Nakano; Koji Nakai, both of Sakaishi, Japan

[73] Assignee: Kubota, Ltd., Osaka, Japan

[21] Appl. No.: 785,831

[22] Filed: Apr. 8, 1977

[30] Foreign Application Priority Data

Jan. 24, 1977 [JP] Japan ..... 52-7143

[51] Int. Cl.[2] ..... F02F 7/00

[52] U.S. Cl. ..... 123/195 A; 123/198 E

[58] Field of Search ..... 123/198 E, 195 A, 195 C, 123/198 R, 41.69, 52 MV

[56] References Cited

U.S. PATENT DOCUMENTS

| | | | |
|---|---|---|---|
| 1,922,200 | 8/1933 | Frank | 123/198 E |
| 2,086,036 | 7/1937 | Tuergens | 123/198 E |
| 2,177,687 | 10/1939 | Bracken et al. | 123/198 E |
| 3,521,726 | 7/1970 | Freyn | 123/198 E X |
| 3,882,951 | 5/1975 | Conley | 123/198 E X |
| 3,924,597 | 12/1975 | Hatz et al. | 123/198 E |
| 3,949,724 | 4/1976 | Thien et al. | 123/198 E |
| 3,949,726 | 4/1976 | List | 123/198 E |
| 3,951,114 | 4/1976 | Fachbach et al. | 123/198 E X |
| 3,973,548 | 8/1976 | Celli | 123/195 A |
| 4,011,849 | 3/1977 | Latham | 123/198 E |

*Primary Examiner*—Ira S. Lazarus
*Attorney, Agent, or Firm*—Bacon & Thomas

[57] ABSTRACT

An engine is provided having a pair of cylinders, the cylinders being arranged in the shape of the letter V on the crankcase, whereby partially enclosed spaces are formed between the cylinders, and between the cylinders and the crankcase. Engine auxiliary components and fittings, including an air cleaner, a carburetor, a self-starter, an accelerator mechanism, an oil filter, an oil gauge and a lubricant orifice are mounted in said partially enclosed spaces to provide an engine assembly of minimum size in which the auxiliary components are relatively protected from damage.

8 Claims, 6 Drawing Figures

ENGINE AND COMPONENT ARRANGEMENT

BACKGROUND OF THE INVENTION

1. Field of the Invention

The present invention relates generally to engine assemblies, and the arrangement of auxiliary components relative to the engine. More particularly, it relates to a uniquely shaped engine including a pair of cylinders arranged in the form of the letter V to provide partially enclosed spaces in which other components of the engine assembly are located.

2. Description of the Prior Art

It is known to arrange the cylinders of an engine in the form of the letter V. One of the disadvantages with the conventional V-shaped engine, however, is its large size due to the space occupied by the normal V-shaped arrangement of the cylinders. In addition, the conventional V-shaped engine is commonly provided with many auxiliary components and fittings, such as an air cleaner, a carburetor, a self-starter, an accelerator mechanism, an oil filter, an oil gauge, a lubricant orifice, and the like, all of which are simply mounted on the exterior of the engine and project therefrom. The result is that the size of the engine assembly is further increased, and the externally located components are placed in danger of being damaged by collisions with other objects.

There is need for an improved V-engine assembly design, and the present invention is intended to satisfy that need.

SUMMARY OF THE INVENTION

In the engine assembly of the invention, a pair of cylinders are arranged in a letter V form on the crankcase, so that partially enclosed spaces are formed between each cylinder and the crankcase, and between the cylinders themselves. These partially enclosed spaces are then utilized to accommodate other components of the engine assembly.

Specifically, auxiliary fittings and components, such as the self-starter, the accelerator mechanism, the oil filter, the oil gauge, and the lubricant orifice are located within the partially enclosed spaces formed between the cylinders and the crankcase. A partially enclosed space is also provided in the region bounded by the axes of the cylinders. This space accommodates such fittings as the inlet pipe, the carburetor and the air cleaner.

The result of this unique design is that the overall dimensions of the engine assembly are held to a minimum, and engine weight is reduced. In addition, the auxiliary components are partially protected by the engine cylinders and crankcase, so that the possibility of accidental damage thereto from collision with other objects is minimized.

It is the principal object of the present invention to provide a V-shaped engine assembly of minimum overall dimensions.

Another object is to provide an engine assembly wherein the auxiliary components are mounted within partially enclosed spaces for protection against accidental collisions with other objects.

Yet another object is to provide a V-shaped engine of minimum weight, which has partially enclosed spaces therearound, within which auxiliary components and fittings can be placed.

Other objects and many of the attendant advantages of the invention will become readily apparent from the following Description of the Preferred Embodiment, when taken in conjunction with the accompanying drawings.

DESCRIPTION OF THE PREFERRED EMBODIMENTS

Figure 1:
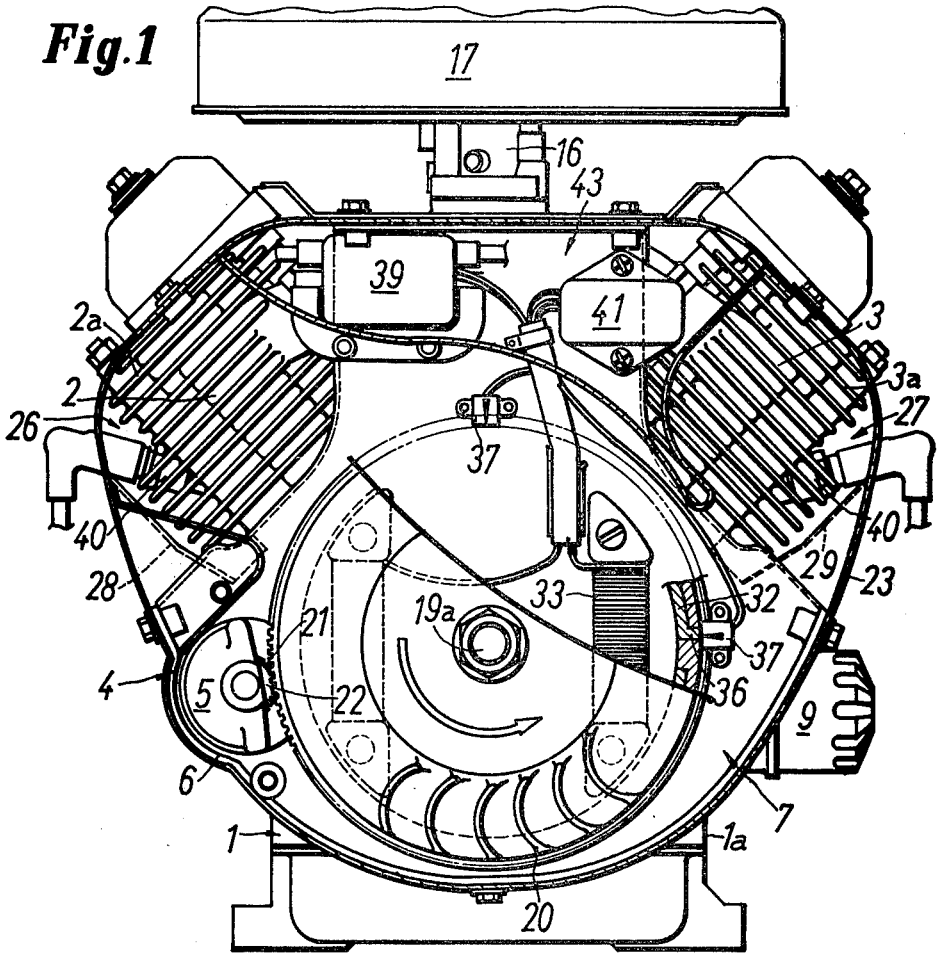
FIG. 1 is a vertical cross-sectional view through an air-cooled, two-cylinder type engine assembly constructed according to the invention.
Figure 2:
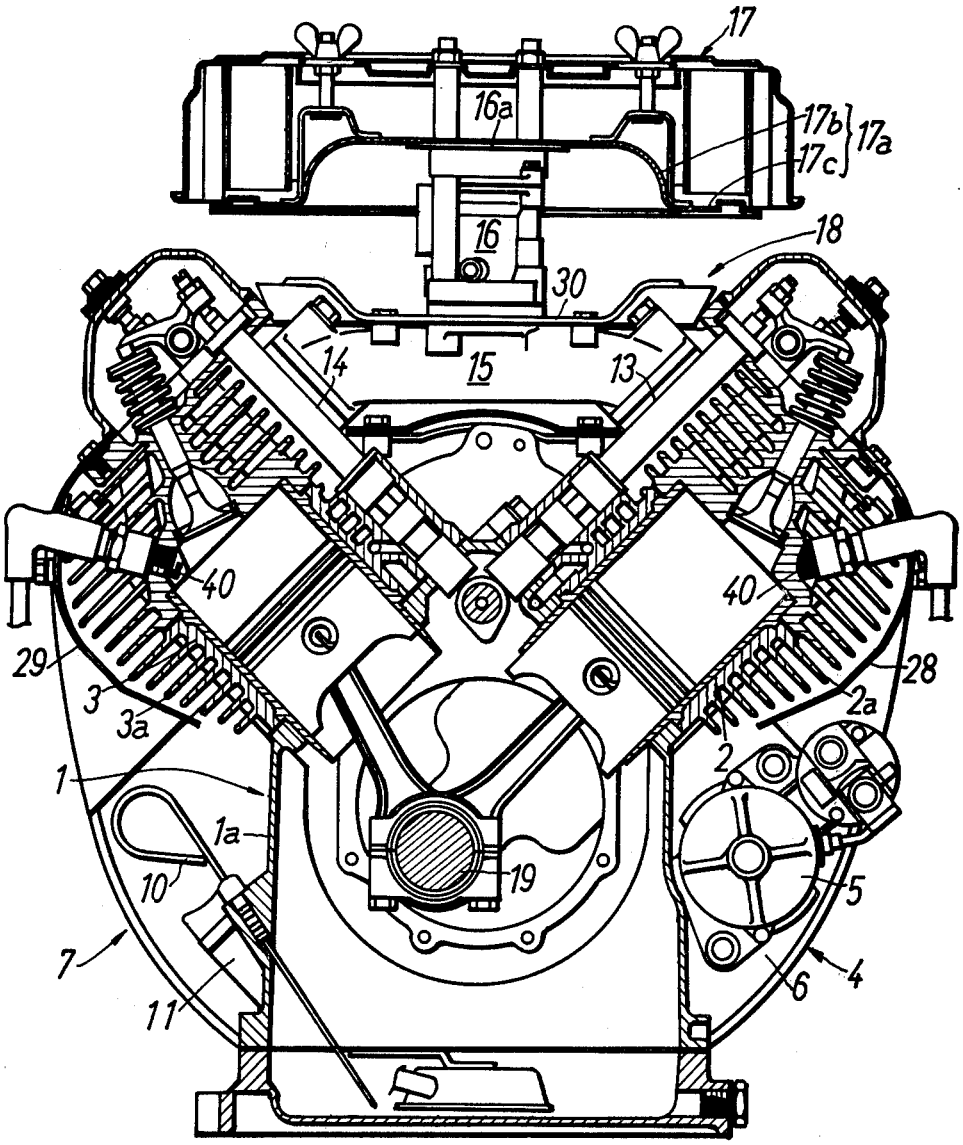
FIG. 2 is a rear, vertical cross-sectional view through the engine of FIG. 1.

Referring now to FIGS. 1 and 2 of the drawings, there is shown a two-cylinder type engine assembly constructed according to the invention. In said FIGS., the engine includes a pair of cylinders 2 and 3 arranged in a V-form on a crankcase 1, with a partially enclosed space 4 being formed between the cylinder 2 and the crankcase 1, a partially enclosed space 7 being formed between the cylinder 3 and said crankcase, and a partially enclosed valley-shaped space 18 being formed between the axes of the cylinders 2 and 3.

Figure 3:
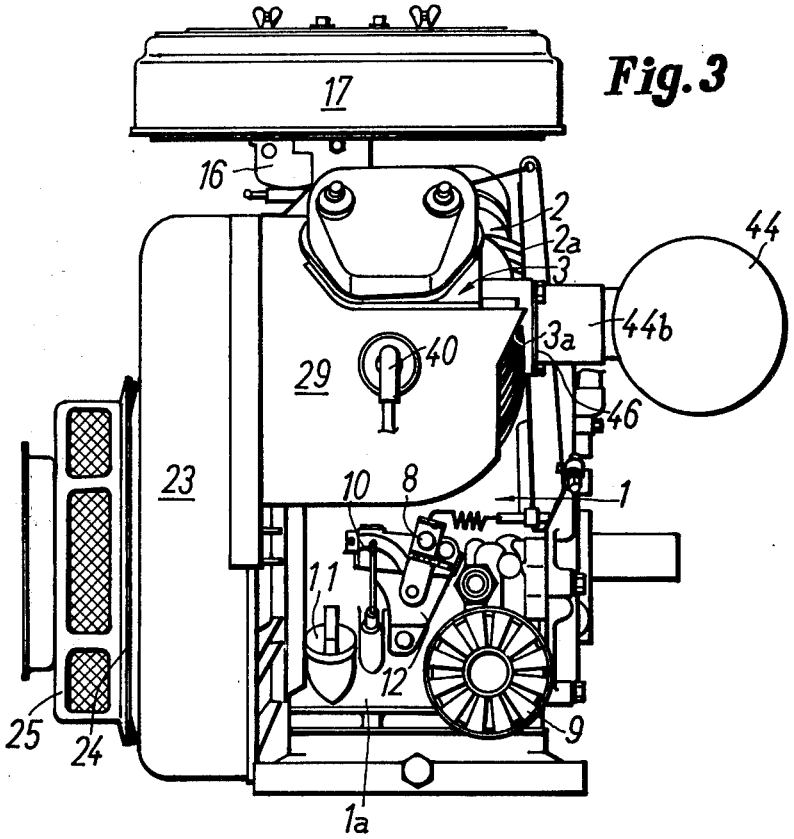
FIG. 3 is a side elevational view of the engine of FIGS. 1 and 2.

In the partially enclosed space 4 there is mounted a self-starter 5, which is fixed to a mounting plate 6 extended from the front face of the crankcase 1. An accelerator assembly 8, an oil filter 9, an oil gauge 10 and a lubricant orifice 11 are provided in the space 7 on the other side of the engine, with the accelerator arm of the assembly 8 being pivoted to the wall 1*a* of the crankcase 1 through a bracket 12, as is best illustrated in FIG. 3. The oil filter 9 is fixed on the lower portion of the wall 1*a*, and the oil gauge 10 is also placed on said wall, to which the oil inlet orifice 11 is adjacent.

The inlet ports 13 and 14 of the cylinders 2 and 3 are provided with a common branch duct 15, on which a downdraft type carburetor 16 is mounted in an upright position, with an air cleaner 17 on its air inlet 16*a*. The air cleaner 17 is disc shaped, and includes a filter made of filtering paper.

The branch duct 15 is located in the valley-shaped, partially enclosed space formed between the cylinders 2 and 3, and the air cleaner 17 is situated to project upwardly out of this space, but without extending past the boundary defined by the axes of the cylinders 2 and 3. The air cleaner 17 has a bottom consisting of two sections 17*b* and 17*c*, the bottom being generally referred to as 17*a*. The section 17*b* is concave, while the section 17*c* is made as a rim of the section 17*b*.

One end 19*a* of a crank shaft 19 projects from the front face of the crankcase 1, to which end portion a flywheel fan 20 is fixed. On the rear part of the periphery of the flywheel there are provided teeth 21, which match counter-teeth 22 carried by the self-starter 5. The front portion of the flywheel and the cylinders 2 and 3 are covered by a hood 23 designed to permit the passage of air, the hood being fixed on a mounting plate 6. The port 24 of the hood 23 is open in a lower portion of the hood, and is covered by a cover 25 against the intrusion of dust. Two outlet ports 26 and 27 of the hood are opened towards the cylinders 2 and 3, respectively.

Figure 4:
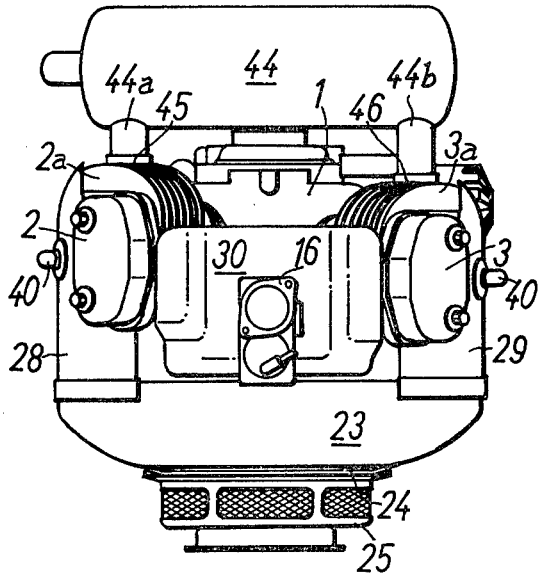
FIG. 4 is a plan view of the engine of FIGS. 1 and 2, but with the air cleaner omitted.

The cylinders 2 and 3 are provided with fins 2*a* and 3*a*, respectively, on their peripheries. The outward sides of each group of fins 2*a* and 3*a* are respectively covered by covers 28 and 29, as is best illustrated in FIG. 4. The covers 28 and 29 are connected to the outlet ports 26 and 27 of the hood 23 at one end of each, and have openings at their opposite ends that open backwards against the cylinders 2 and 3. Between the branch 15 and the carburetor 16 there is provided a heat shield 30, so as to protect the carburetor against the cooling wind used to cool the cylinders. Thus, an accident due to an abnormal rise in temperature, such as percolation, is effectively prevented, and a proper atomization of fuel is assured to take place in the carburetor. In addition, it is advantageous that the mixture is heated and becomes more inflammable during passage through the inlet branch pipe 15.

Figure 5:
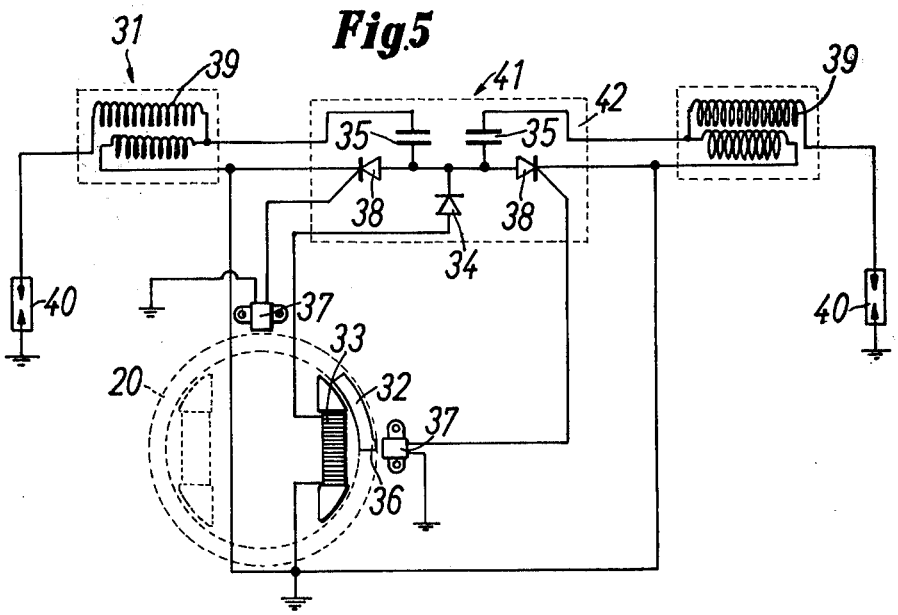
FIG. 5 is a circuit diagram of a CDI system noncontact ignition device utilized with the engine of the invention.

The igniter 31 of the engine of FIGS. 1–4 is a C.D.I. (Condenser Discharge Ignition system) non-contact type, which is illustrated in FIG. 5. As the diagram shows, when the flywheel fan 20 is rotated, an exciter 32 carried thereby electrically affects an exciting coil 33 fixed to the crankcase 1, so as to produce an a.c. current, which is then converted into a d.c. current by a diode 34. The d.c. current is then stored in a capacitor 35. In this situation, when a pulser element 36 attached to the fan 20 produces pulses in a coil 37 on the crankcase, a silicon controlled rectifier 38 is energized, and a discharge of the capacitor 35 occurs that is effective to light at an igniter plug 40 via an igniter coil 39. The reference numeral 41 denotes the C.D.I. unit, which includes the diode 34, the capacitor 35, and the silicon controlled rectifier 38, these elements being appropriately embedded in a carrier 42 of insulating material. The igniter coil 39 and the C.D.I. unit 41 are housed side-by-side within the space 43 produced in the upper part of the hood 23 between the cylinders 2 and 3, and are carried by a mounting plate 6. The space 43 would otherwise be of no use.

As best shown in FIGS. 3 and 4, a muffler 44 is horizontally supported outside the cylinders 2 and 3, the muffler communicating with the cylinders 2 and 3 by means of pipes 44*a* and 44*b* connected respectively to ports 45 and 46 of said cylinders. The muffler, the self starter, the accelerator, the oil gauge, and the lubricant orifice are compactly accommodated without protruding portions within the space behind the hood 23, with the sole exception that the oil filter 9 extends laterally slightly beyond the hood.

Figure 6:
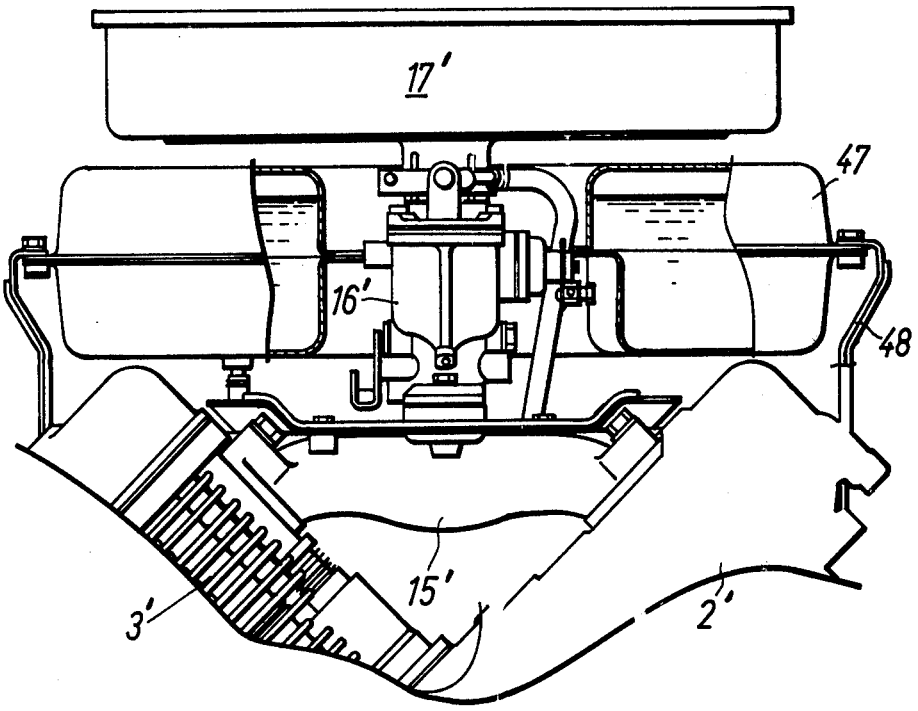
FIG. 6 is a fragmentary, schematic front view of a modified version of the engine assembly of the invention.

A modified embodiment of the invention is illustrated in FIG. 6, provided with a fuel tank 47 mounted between an air cleaner 17' and the cylinders 2' and 3', the fuel tank being ring-shaped so as to surround the carburetor 16'. The tank 47 is supported by braces 48 on the cylinders 2' and 3'. Fuel from the tank 47 is delivered to the carburetor 16' by a pump (not shown), via a suitable filter (not shown).

As is evident from the foregoing, in the present invention auxiliary components and fittings of the engine assembly are appropriately housed in the partially enclosed spaces produced around the body of the unique V-shaped engine. As a result, the engine takes little space and is very compact. In addition, the fittings are protected against a possible collision with other objects by virtue of their trim accommodation, and engine weight is reduced over the usual solid block engine provided with V-shaped cylinders.

What is claimed is:

1. An engine assembly, comprising:

a V-shaped engine having a main rotating shaft and a crankcase, and including a pair of free standing cylinders with cooling fins thereon arranged in the letter V on the opposite sides of said crankcase, whereby partially enclosed spaces are formed on both sides of said crankcase between the crankcase and the inclined undersides of said cylinders, and a valley-shaped space is formed between said cylinders on top of said crankcase, said valley-shaped space being open at the top and extending longitudinally of said crankcase with no intrusion thereinto by any portion of the crankcase or by operating engine elements associated with said cooling-fin equipped cylinders; and auxiliary components for said engine, said auxiliary components being mounted within said partially enclosed spaces beneath said cylinders and within said valley-shaped space on top of said crankcase between said cooling-fin equipped cylinders, to provide an engine assembly of minimum overall dimensions, and to protect said components.

2. An engine assembly as recited in claim 1, wherein said auxiliary components include:

a self-starter mounted within one of said partially enclosed spaces formed between the inclined underside of one of said cylinders and said crankcase;

an accelerator mechanism, an oil filter, an oil gauge and a lubricant orifice mounted with the partially enclosed spaced formed on the other side of said crankcase between said crankcase and the inclined underside of the other of said cylinders;

an inlet duct disposed within said valley-shaped space, and extending thereacross between said cylinders;

a carburetor mounted on said inlet duct; and a disc-shaped air cleaner mounted on said carburetor, said air cleaner having an external diameter so as not to extend laterally beyond a V-shaped space defined by the axes of said cylinders.

3. An engine assembly as recited in claim 2, wherein said air cleaner has a concave bottom, to thereby enlarge the space over said cylinders.

4. An engine assembly as recited in claim 2, including additionally:

a flywheel fan provided on the front face of said crankcase, said fan being carried on the main rotating shaft of said engine, and being covered by a hood permitting the passage of air.

5. An engine assembly as recited in claim 4, wherein said self-starter, said accelerator mechanism, said oil filter, said oil gauge, and said lubricant orifice are located and arranged behind said hood so they do not protrude laterally therebeyond.

6. An engine assembly as recited in claim 5, including additionally:

cover means extending between said hood and said cylinders, said cylinders having cooling fins thereon, and said cover means covering said cooling fins and communicating with said hood for the passage of cooling air.

7. An engine assembly as recited in claim 6, including additionally:

a heat shield plate located between said inlet duct and said carburetor, for preventing the flow of cooling air from reaching said carburetor from said cylinders.

8. An engine assembly as recited in claim 2, including additionally:

a ring-shaped fuel tank mounted in said valley-shaped space beneath said air cleaner, and surrounding said carburetor.

* * * * *